US005580402A

United States Patent [19]

Fujita et al.

[11] Patent Number: 5,580,402

[45] Date of Patent: Dec. 3, 1996

[54] LOW BAKING TEMPERATURE HARDENABLE ALUMINUM ALLOY SHEET FOR PRESS-FORMING

[75] Inventors: Takeshi Fujita; Masakazu Niikura; Shinji Mitao; Masataka Suga; Kohei Hasegawa, all of Tokyo, Japan

[73] Assignee: NKK Corporation, Tokyo, Japan

[21] Appl. No.: 156,034

[22] Filed: Nov. 19, 1993

[30] Foreign Application Priority Data

Mar. 3, 1993 [JP] Japan ..... 5-066006

[51] Int. Cl.[6] ..... C22C 21/08

[52] U.S. Cl. ..... 148/417; 148/418

[58] Field of Search ..... 148/417, 418; 420/534–536, 532

[56] References Cited

U.S. PATENT DOCUMENTS

| | | | |
|---|---|---|---|
| 4,753,685 | 6/1988 | Usui et al. | 148/417 |
| 4,838,958 | 6/1989 | Komatsubara et al. | 148/417 |
| 5,282,909 | 2/1994 | Ara et al. | 420/530 |
| 5,441,582 | 8/1995 | Fujita et al. | 148/693 |
| 5,460,666 | 10/1995 | Fujita et al. | 148/417 |

FOREIGN PATENT DOCUMENTS

| | | | |
|---|---|---|---|
| 1223217 | 6/1960 | France | 420/536 |
| 53-103914 | 9/1978 | Japan . | |
| 57-120648 | 7/1982 | Japan . | |
| 1-225738 | 9/1989 | Japan . | |
| 2-8353 | 1/1990 | Japan . | |
| 2-47234 | 2/1990 | Japan . | |
| 4-263034 | 9/1992 | Japan . | |
| 4304339 | 10/1992 | Japan . | |
| 4-365834 | 12/1992 | Japan . | |
| 5-43974 | 2/1993 | Japan . | |
| 5125504 | 5/1993 | Japan . | |
| 5271836 | 10/1993 | Japan . | |
| 93/02220 | 2/1993 | WIPO . | |

OTHER PUBLICATIONS

Tekkou Shinbun (Steel News Paper) of Jul. 27, 1993; Japan.

Kagaku Nippou (Daily News of Chemical Industry) of Jul. 22, 1993; Japan.

Komatsu et al, "Development of All Body for Automotive", vol. 45, No. 6, (1991), pp. 42–48.

Yoshida et al, "Properties of Aluminium Alloy Sheets for Auto Bodies", vol. 32, No. 1, (1991), pp. 20–31.

*Primary Examiner*—David A. Simmons

*Assistant Examiner*—Margery S. Phipps

*Attorney, Agent, or Firm*—Frishauf, Holtz, Goodman, Langer & Chick, P.C.

[57] ABSTRACT

Disclosed is an aluminum alloy sheet having a chemical composition of an Si-containing Al—Mg—CU alloy. The aluminum alloy sheet exhibits a streak-shaped modulated structure at a diffraction grating points of an Al—Cu—Mg—system compound in the electron beam diffraction grating image. The above mentioned streak can be generated efficiently when the alloy essentially consists of 1.5 to 3.5% by weight of Mg, 0.3 to 1.0% by weight of Cu, 0.05 to 0.6% by weight of Si, and the balance of Al and inevitable impurities, and the ratio of Mg/Cu is in the range of 2 to 7. The alloy contains 0.01–0.50% of at least one element selected from the group consisting of Sn, Cd, and In.

6 Claims, 5 Drawing Sheets

LOW BAKING TEMPERATURE HARDENABLE ALUMINUM ALLOY SHEET FOR PRESS-FORMING

BACKGROUND OF THE INVENTION

1. Field of the Invention

The present invention relates to an aluminum alloy sheet for use in press forming and a method of manufacturing the same, more particularly, to an aluminum alloy sheet suitable for use in an automobile body, exhibiting excellent bake hardening property, even if baking is performed at a low temperature in the range of 120° to 180° C. for a short period of time of 5 to 40 minutes.

2. Description of the Related Art

A conventional surface-treated cold-rolled steel sheet has frequently been used as a sheet material for automobile body panels. In recent years, however, for the purpose of reducing fuel consumption, a light-weight automobile body panel material has been demanded. To satisfy the demand, aluminum alloy sheets have begun to be used for the automobile body panel.

Nowadays, manufacturers in press forming of panel sheets are requesting that the material not only have low yield strength until being subjected to press forming so as to provide a satisfactory shape-retaining property [Jidosha Gijyutu (Automobile Technology), Vol. 45, No. 6 (1991), 45)], but also have a property such that strength thereof can improved during paint baking to provide satisfactory formability of deep drawing and overhang, and dent resistance.

Under these circumstances, an attempt has been made in which the strength of the material was improved by adding Cu and Zn to a non-heat treated type, Al-Mg based alloy which has superior formability to other aluminum alloys. As a result, an Al—Mg—Cu alloy (Jpn. Pat. Appln. KOKAI Publication Nos. 57-120648, 1-225738), an Al—Mg—Cu—Zn alloy (Jpn. Pat. Appln. KOKAI Publication No. 53-103914), and the like have been developed. These alloy sheets are superior to an Al—Mg—Si alloy sheet but inferior to a conventional surface-treated cold-rolled steel sheet in formability, and exhibit a poor shape-retaining property since the alloy sheets have high strength prior to being press formed. In addition, the degree of hardening obtained by paint baking is not sufficient, and the degree of hardening is low only to prevent work hardening value obtained by press-forming from lowering. In Jpn. Pat. Appln. KOKAI Publication No. 57-120648, an attempt has been made to improve the strength at the time of the paint baking by precipitating an Al—Cu—Mg compound; however, the results have not been satisfactory. Since the effect of Si in improving bake hardening was not yet discovered at the time the aforementioned application was made, Si was limited to a low level.

A conventional 5052 material is used in the automobile body panel. Although it exhibits a superior shape-retaining property owning to low yield strength prior to being subjected to press forming, 5052-0 is inferior in dent resistance since satisfactory hardness cannot be provided by paint baking.

The above mentioned Al—Mg—CU or Al—Mg—CU—Zn alloys have a common disadvantage in that the alloys exhibit a secular change in the strength prior to press forming because natural aging starts right after the final heat treatment ["Report of 31st light metal Annual Symposium", Sumi-kei Giho (Sumitomo Light Metals Technical Report), Vol. 32, No. 1 (1991), 20, page 31)]. Therefore, it is necessary to control the timing of the manufacturing raw material and heat treatment, and a period of time from the heat treatment to press forming.

One technique of suppressing the secular change in the strength by natural aging is provided by Jpn. Pat. Appln. KOKAI Publication No. 2-47234, which discloses that natural aging of the Al—Mg—CU—Zn alloy is suppressed by reducing a content of Zn, which has a significant effect on natural aging.

Nevertheless, heretofore, there have been no alloy which provides satisfactory bake hardening, shape-retaining property, and natural aging retardation, even though they may have excellent formability relatively close to that of steel.

SUMMARY OF THE INVENTION

The present invention has been made in view of the above circumstances. An object of the present invention is to provide an aluminum alloy sheet for use in press forming, having excellent bake hardening property by baking at low temperatures for a short period of time and a method of manufacturing the same.

Another object of the present invention is to provide an aluminum alloy sheet for use in press forming, exhibiting no secular change in strength prior to press forming owing to low strength prior to being subjected to press forming and a natural aging retardation property.

According to a first aspect of the present invention, there is provided an aluminum alloy sheet for use in press forming, having an excellent property of hardening by baking at a low temperature for a short period of time, said sheet comprising a Si-containing Al—Mg—Cu alloy, wherein streaks are observed in its electron diffraction pattern when it is baked at a temperature of 120° to 180° C. for 5 to 40 minutes, said streaks indicating presence of a modulated structure of an Al—Cu—Mg compound.

According to a second aspect of the present invention, there is provided an aluminum alloy sheet for use in press forming, having an excellent property of hardening by baking at low temperature for a short period of time, said alloy sheet essentially consisting of 1.5 to 3.5% by weight of Mg, 0.3 to 1.0% by weight of Cu, 0.05 to 0.6% by weight of Si, and a balance of Al and inevitable impurities, wherein the ratio Mg/Cu is in the range of 2 to 7.

According to a third aspect of the present invention, there is provided an aluminum alloy sheet for use in press forming, having an excellent property of hardening by baking at low temperature for a short period of time, further comprising at least one element selected from the group consisting of 0.01 to 0.50% by weight of Sn, 0.01 to 0.50% by weight of Cd, and 0.01 to 0.50% by weight of In, in addition to the aforementioned compounds.

According to a fourth aspect of the present invention, there is provided a method of manufacturing an aluminum alloy sheet for use in press forming, having excellent property of hardening by baking at low temperature for a short period of time, said method comprising the steps of;

preparing an aluminum alloy ingot essentially consisting of 1.5 to 3.5% by weight of Mg, 0.3 to 1.0% by weight of Cu, 0.05 to 0.6% by weight of Si, and a balance of Al and inevitable impurities, in which the ratio of Mg/Cu is in the range of 2 to 7;

homogenizing the ingot in one step or in multiple steps, performed at a temperature within the range of 400° to 580° C.;

preparing an alloy sheet having a desired sheet thickness by subjecting the ingot to a hot rolling and a cold rolling; and subjecting the alloy sheet to a heat treatment including heating the sheet up to a range of 500° to 580° C. at a heating rate of 3° C. second or more, keeping it at the temperature reached for 0 to 60 seconds, and cooling it to 100° C. at a cooling rate of 2° C. second or more.

According to a fifth aspect of the present invention, there is provided a method of manufacturing an aluminum alloy sheet for use in press forming, having an excellent property of hardening by baking at the low temperature for the short period of time in which the ingot further comprises at least one element selected from the group consisting of 0.01 to 0.50% by weight of Sn, 0.01 to 0.50% by weight of Cd, and 0.01 to 0.50% by weight of In, in addition to the above specified components.

According to a sixth aspect of the present invention, there is provided an aluminum alloy sheet for use in press forming, having an excellent property of hardening by baking at low temperature for a short period of time, said method comprising steps of;

preparing an aluminum alloy ingot essentially consisting of 1.5 to 3.5% by weight of Mg, 0.3 to 1.0% by weight of Cu, 0.05 to 0.6% by weight of Si, and a balance of Al and inevitable impurities, in which the ratio of Mg/Cu is in the range of 2 to 7.

homogenizing the ingot in one step or in a multiple steps at a temperature within the range of 400° to 580° C.;

subjecting the ingot to a hot rolling and a cold rolling or hot rolling only to form an allay sheet stock;

subjecting the stock to an intermediate tempering treatment including heating the ingot up to a range of 500° to 580° C. at a heating rate of 3° C./second or more, keeping it at the temperature reached for 0 to 60 seconds, and cooling it to 100° C. at a cooling rate of 2° C./second or more;

preparing an alloy sheet having a desired thickness by subjecting the stock to a cold rolling treatment at a rolling rate of 5 to 45%; and subjecting the alloy sheet to a heat treatment including heating the ingot up to a range of 500° to 580° C. at a heating rate of 3° C./second or more, keeping it at the temperature reached for 0 to 60 seconds, and cooling it to 100° C. at a cooling rate of 2° C./second or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The present inventors have made intensive and extensive studies with a view toward attaining the above mentioned objects. As a result, they found that sufficient bake hardening can be obtained in an Al—Mg—CU alloy, when generation of a GPB zone which is a modulated s structure observed prior to precipitating an S' phase made of an Al—Cu—Mg—compound is promoted and a streak is observed in an electron diffraction pattern thereof. To be more specific, if streaks indicating the presence of a modulated structure are observed in its diffraction pattern when it is baked at a temperature of 120° to 180° C. for a time period of 5 to 40 minutes, the bake hardening after the baking at low temperature for a short period of time of above ranges may be excellent. The present invention was made based on the above mentioned finding and provides an aluminum alloy sheet for use in press forming, having excellent property of hardening by baking at low temperature for a short period of time, the aluminum alloy sheet which comprises an Si-containing Al—Mg—CU alloy and streaks are observed in its electron diffraction pattern when it is baked at a temperature of 120° to 180° C. for 5 to 40 minutes, the streaks indicating the presence of a modulated structure of an Al—Cu—Mg—compound.

The above mentioned streaks can be obtained by limiting contents of Cu and Mg of the Al—Mg—Cu alloy to a specific range and adding a certain amount of Si. To be more specific, the streaks can be obtained more efficiently when the alloy essentially consists of 1.5 to 3.5% by weight of Mg, 0.3 to 1.0% by weight of Cu, 0.05 to 0.6% by weight of Si, and the balance of Al and inevitable impurities, and the ratio of Mg/Cu is in the range of 2 to 7.

Figure 1:
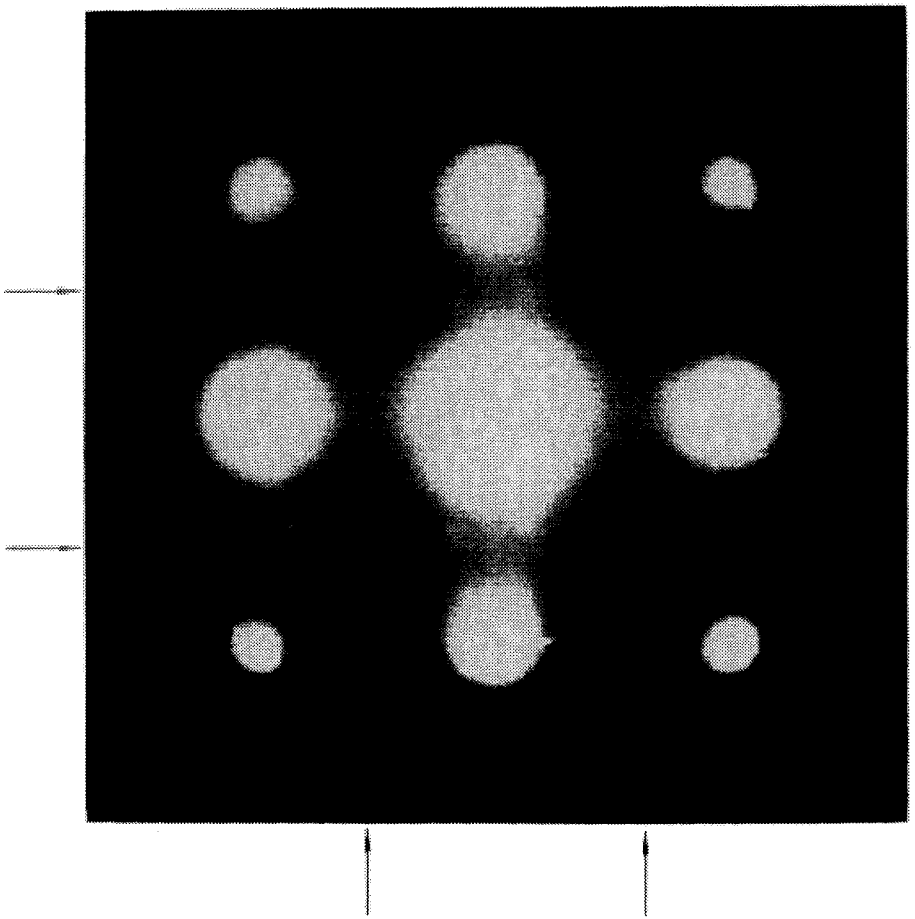
FIG. 1 is a photograph showing a crystal structure of the aluminum alloy sheet according to the present invention.
Figure 2:
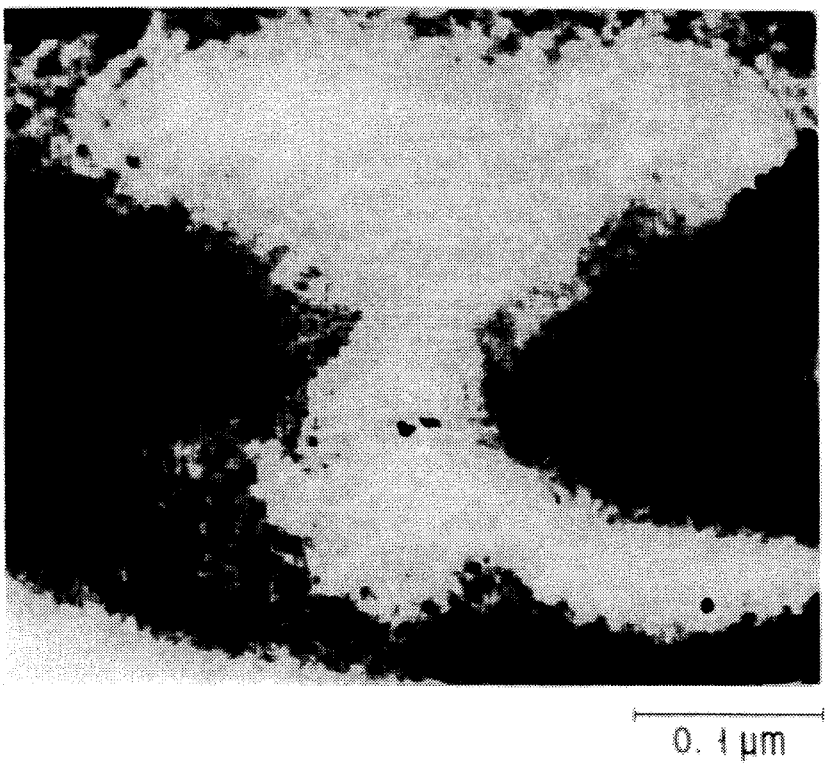
FIG. 2 is a photograph showing the metalographic structure of the aluminum alloy sheet according to the present invention.

FIG. 1 shows an example of the electron diffraction pattern of the modulated structure, which is very thin layers or zones and appears prior to the S' phase as the precipitation phase of Al—Cu—Mg—compound. FIG. 1 shows Al (100) diffraction pattern. Streaks around the reciprocal lattice image of the Al—Cu—Mg—compound was pointed out by an arrow. FIG. 2 is an electron beam transmission image, however, the modulated structure cannot be observed at sites corresponding to those shown in FIG. 1. The results indicate that the above mentioned modulated structure is too fine to be observed in the electron transmission image. Therefore, the modulated structure is unlike precipitates. The fine structure contributes to remarkable improvement of strength, thereby obtaining an aluminum alloy sheet exhibiting the bake hardening.

To retard natural aging of the Al—Mg—Cu system alloy, a preferable chemical composition includes at least one element selected from the group consisting of 0.01 to 0.50% by weight of Sn, 0.01 to 0.50% by weight of Cd, and 0.01 to 0.50% by weight of In, in addition to the above mentioned chemical composition based on the Al—Mg—Cu system alloy containing Si. To be more specific, the aluminum alloy sheet which is hardened by baking accompanies natural aging problem, which is a property that increases the hardness when it is allowed to stand still at room temperature. However, the natural aging can be retarded such that the effect of the natural aging is substantially absence by adding at least one element selected from the above mentioned group.

Even if at least one additional element selected from the group consisting of 0.03 to 0.50% by weight of Fe, 0.005 to 0.15% by weight of Ti, 0.0002 to 0.05% by weight of B, 0.01 to 0.50% by weight of Mn, 0.01 to 0.15% by weight of Cr, 0.01 to 0.12% by weight of Zr, 0.01 to 0.18% by weight of V, and 0.5% or less by weight of Zn, is further added to the chemical composition of Si-containing Al—Mg—Cu alloy or to the chemical composition having the above mentioned element which has effect on natural aging retardation, the effect of the present invention would not be lessened.

To retard the natural aging of the Al—Mg—Cu system alloy, it is preferable that the alloy contains 1.5 to 3.5% by weight of Mg, 0.3 to 0.7% by weight of Cu, 0.05 to 0.35% by weight of Si, the ratio of Mg/Cu is in the range of 2 to 7.

Hereinbelow, the reason why individual components are defined as described above will be explained. Each content is shown in the terms of weight percentages.

Mg: Mg is a constitutional element of the Al—Cu—Mg—modulated structure of the present invention. At the Mg content of less than 1.5%, the generation of the modulated structure is retarded, and the modulated structure cannot be generated, when the alloy sheet is subjected to baking at a temperature of 120° to 180° C. for a baking period of time from 5 to 40 minutes. Further, at the Mg content of less than 1.5%, ductility is lowered. On the other hand, when the content exceeds 3.5%, the generation of the modulated structure is also retarded, and no modulated structure is generated, when the alloy sheet is subjected to baking at a temperature in the range of 120° to 180° C. for a baking period of time from 5 to 40 minutes. Therefore, it is desirable that the Mg content is in a range of 1.5 to 3.5%.

Cu: Cu is a constitutional element of the Al—Cu—Mg—modulated structure of the present invention. At the Cu content of less than 0.3%, the modulated structure cannot be generated. when the content exceeds 1.0%, corrosion resistance remarkably deteriorates. Therefore, it is desirable to contain Cu in a range of 0.3 to 1.0%. However, when the Cu content exceeds 0.7%, the Al—Cu—Mg—modulated structure is generated even at ordinary temperature. As a result, the secular change in strength of the alloy generates. Therefore, the degree of bake hardening is decrease. Furthermore, corrosion resistance deteriorates in some extent. Hence, it is more desirable the Cu content is in a range of 0.3 to 0.7% taking natural aging problem and corrosion resistance into consideration.

The ratio of Mg to Cu (Mg/Cu) is desirably in the range of 2 to 7. Within the range, the modulated structure can be effectively generated.

Figure 3:
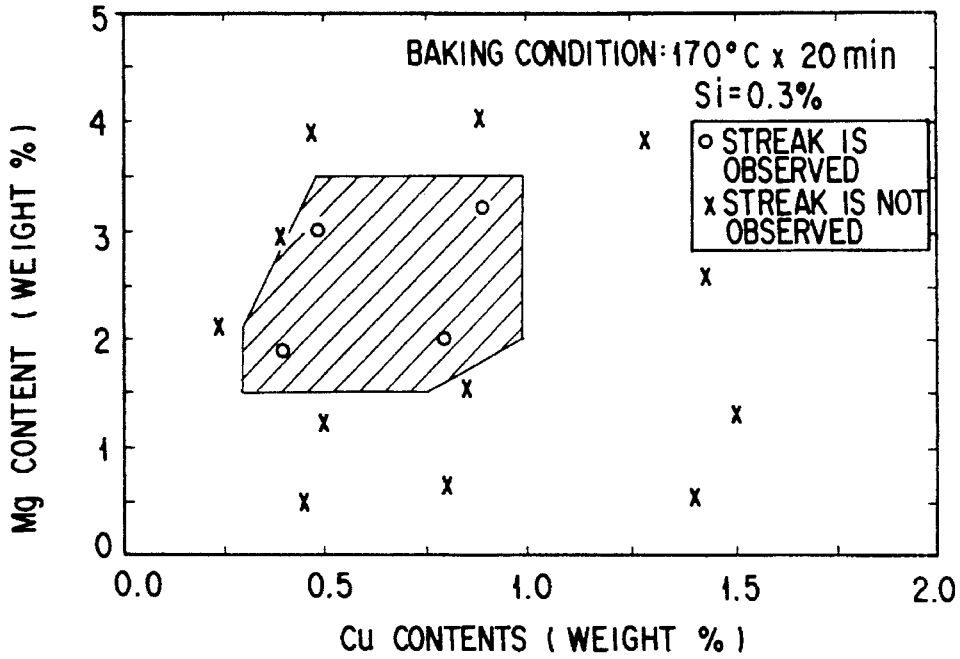
FIG. 3 is a graph showing the effect of Mg and Cu on streak generation corresponding to a modulated structure of the Al—Cu—Mg—system compound in an electron beam diffraction grating image.

FIG. 3 is a graph showing the relationship between the presence or absence of streak observed in electron beam diffraction grating and the ratio of Mg to Cu. As is apparent from in FIG. 3, a streak is observed when the ratio of Mg to Cu is in the above mentioned range.

Si: Si is an element which improves a hardenability by facilitating generation of the Al—Cu—Mg—modulated structure and suppresses natural aging. To perform the function efficiently, it is desirable that the Si content is 0.05% or more. when the Si content exceeds 0.6%, the above mentioned modulated structure is generated, however, at the same time, a GP (1) modulated structure of $Mg_2Si$ is also generated. The GP (1) modulated structure facilitates natural aging which leads to remarkable increase with time in the strength of the sheets prior to being subjected to a baking treatment. As a result, the degree of bake hardening is reduced. Therefore, it is desirable that the Si content is 0.6% or less.

Figure 4:
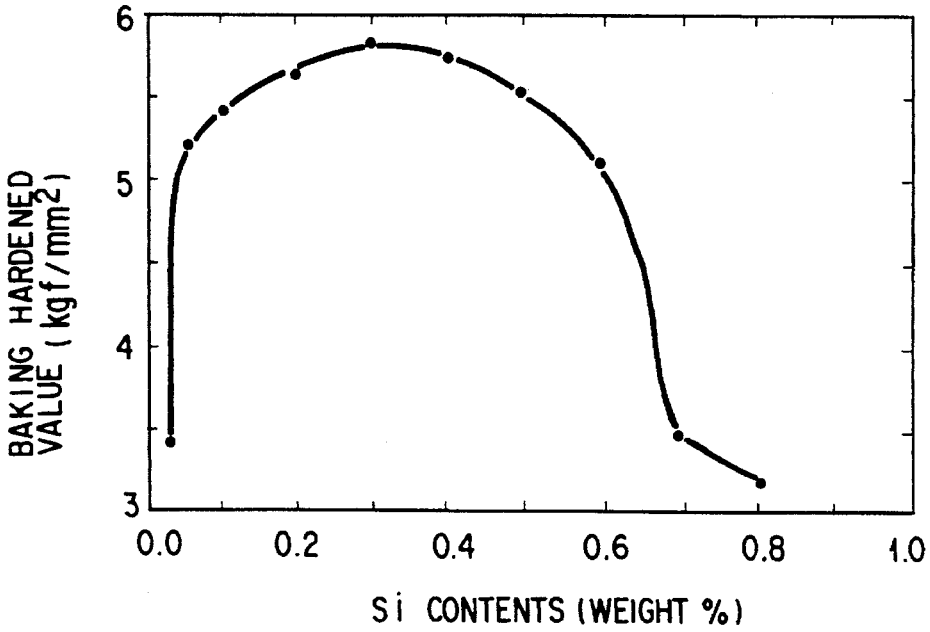
FIG. 4 is a graph showing the effect of Si on the degree of bake hardening.

FIG. 4 shows the effect of the Si content on the degree of bake hardening. FIG. 4 shows the case in which an intermediate tempering treatment is not performed in the alloy sheet manufacturing process. The degree of bake hardening by the baking treatment is calculated by subtracting yield strength before the baking treatment from that of after baking treatment. As is apparent from FIG. 4, a higher degree of hardening can be obtained within the above mentioned range.

To retard natural aging without generating the GP (1) modulated structure of $Mg_2$ Si, it is desirable that the Si content is especially 0.35% or less.

Figure 5A:
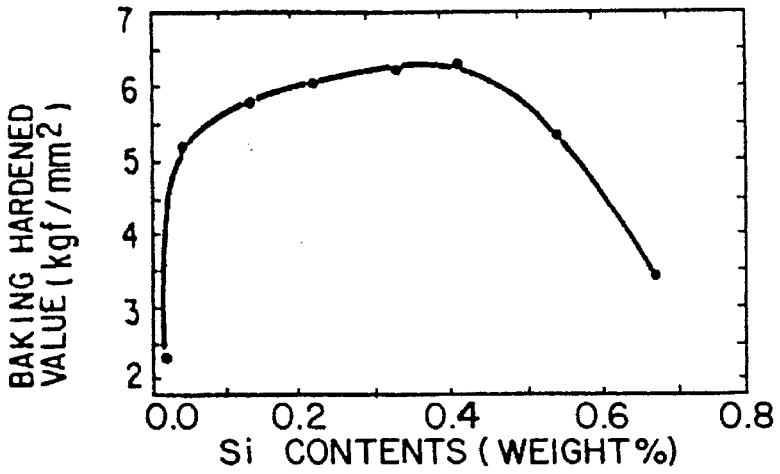
FIGS. 5A and 5B are graphs showing the effect of Si on the degree of bake hardening and on the degree of natural aging.
Figure 5B:
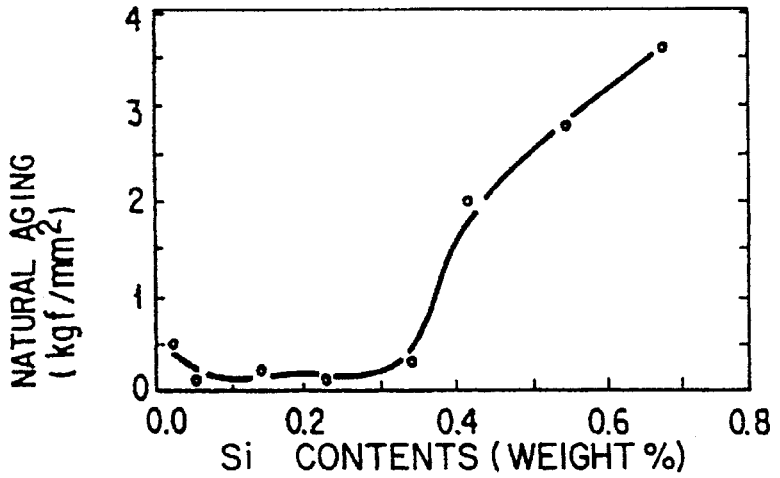

FIG. 5A is a graph which shows the effect of the Si content on baking hardening. FIG. 5B is a graph which shows the effect of the Si content on natural aging. As is apparent from FIGS. 5A and 5B, natural aging is retarded when Si content is within the range of 0.05 to 0.35%, while the value of bake hardening is maintained 5 $Kgf/mm^2$.

Elements other than these above mentioned basic elements are also restricted for the following reasons.

Sn, In, Cd: These alloy elements are the atoms which strongly bind to frozen vacancies generated by a quenching treatment performed after a solution treatment. Therefore, the number of vacant holes which are served as GPB zone forming sites of the Al—Cu—Mg—compound are reduced, thereby retarding natural aging. However, when the content of each element is less than 0.01%, the effect of these elements is not obvious. In contrast, when the content exceeds 0.5%, the effect saturates. That is, the effect is no more produced in proportion to the content, thereby lowering cost performance.

Figure 6:
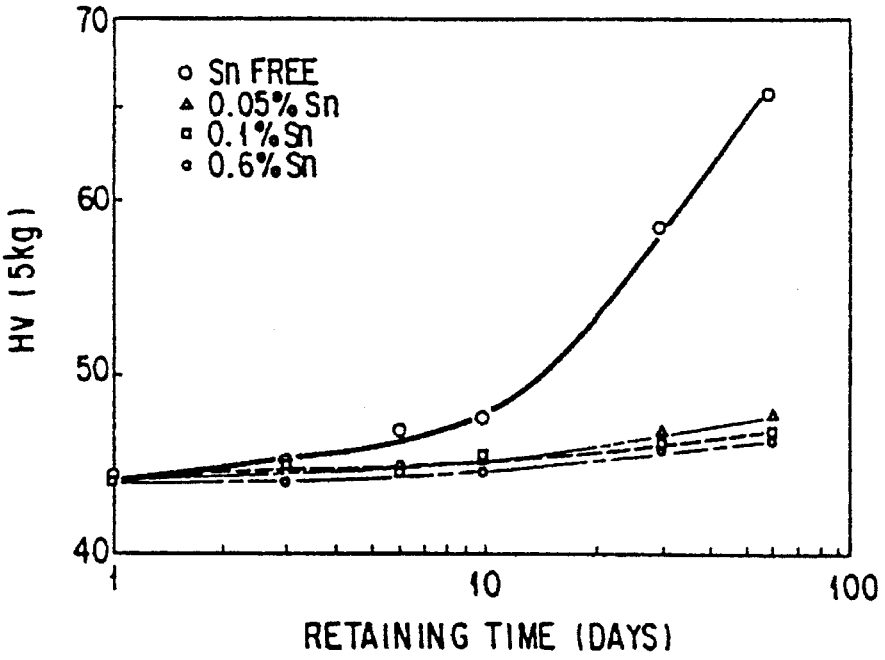
FIG. 6 is a graph showing the effect of Sn on natural aging.

FIG. 6 shows the effect of Sn on natural aging. As is apparent from FIG. 6, 0.05% or more of the Sn content retards natural aging.

Fe: When Fe is present in a content of 0.50% or more, a coarse crystal is readily formed with Al, thereby causing deterioration of the formability. Fe also reduces the content of Si which is effective to form the modulated structure by binding to Si. Therefore, it is desirable that the Fe content is 0.5% or less. However, since a small amount of Fe contributes to formability and the effect can not be obtained when the amount is less than 0.03%, the Fe content is desirably 0.03% or more.

Ti, B: Ti and B are present in the form of $TiB_2$, which improves the workability during hot working by making crystal grains of the ingot fine. Therefore, it is important to add Ti together with B. However, an excess content of Ti and B facilitates generation of a coarse crystal thereby causing deterioration of the formability. Therefore, the contents of Ti and B are desirably in the range such that the effect can be obtained efficiently, that is, the range of 0.005 to 0.15, and 0.0002 to 0.05%, respectively.

Mn, Cr, Zr, V: These elements are recrystallization suppressing elements. In order to suppress abnormal grain growth, these elements may be added in an appropriate amount. However, these elements have a negative effect on equiaxed formation of the recrystallized particle, thereby causing deterioration of the formability. Therefore, the content of these elements should be limited to less than that contained in a conventional aluminum alloy. Hence, the contents of Mn, Cr, Zr, and v are restricted to 0.01 to 0.50%, 0.01 to 0.15%, 0.01 to 0.12%, and 0.01 to 0.18%, respectively.

Zn: Zn is an element which contributes to improving strength. However, the content in excess of 0.5% reduces the degree of bake hardening. To be more specific, in the Zn content exceeding 0.5%, a modulated structure, which is the stage prior to the precipitation of the Al-Zn system compound, may be generated. The modulated structure, however, can be also generated at ordinary temperature and the strength of the alloy sheet prior to be subjected to baking, remarkably increases with time, thereby decreasing the degree of bake hardening. Therefore, it is necessary that the content of Zn should not be exceed 0.5%.

The other element, Be may be added up to 0.01%. Be prevents oxidation at the time of casting, thereby improving castability, hot workability, and formability of an alloy sheet. However, the Be content in excess of 0.01% is not preferable because not only the effect is saturated but also Be turns into a strong poison to damage the working circumstances at the time of casting. Therefore the upper limit of the Be content should be 0.01%.

Besides the above mentioned elements, inevitable impurities are also contained in the aluminum alloy sheet as observed in a conventional one. The amount of the inevitable impurities is not limited as long as the not ruin the effect of the present invention. For example, Na and K, if they are present in a content of 0.001%, may not affect properties of the aluminum alloy.

Hereinbelow, manufacturing conditions to obtain the aluminum alloy sheet of the present invention will be explained.

First, an aluminum alloy whose components and composition are defined above is melted and casted to obtain an ingot by conventional procedure. The ingot is then subjected to a homogenizing heat treatment at a temperature in the range of 400° to 580° C. in one step or in multiple steps, thereby facilitating a diffusion dissoluting of an eutectic compound crystallized at a casting process, and reducing local microsegregation. Further, the homogenizing heat treatment suppresses abnormal growth of crystal grains. As a result, fine grains of compounds of Mn, Cr, Zr, and V, which perform an important function in homogenizing the alloy, can be precipitated. However, when the homogenizing heat treatment is performed at a temperature less than 400° C., the above mentioned effect could not be sufficiently obtained. When the treatment is performed at a temperature in excess of 580° C., a eutectic melting would occur. Therefore, the temperature of the homogenizing heat treatment is defined in the range of 400° to 580° C. When the treatment is performed for the period of time less than one hour at a temperature in the range mentioned above, the effect could not be sufficiently obtained. On the other hand, when this treatment is performed over 72 hours, the effect is saturated. Hence, it is desirable that the reaction time is 1 to 72 hours.

An ingot completed with the homogenizing treatment is then subjected to a hot rolling and a cold rolling to obtain a sheet having a predetermined thickness by conventional procedure. In order to straighten or to adjust surface roughness, 5% or less of leveling, stretching or skin pass rolling may be performed before or after, or before and after the following heat treatment.

After the rolling step, the rolled sheet is subjected to a heat treatment including heating the sheet up to a temperature in the range of 500° to 580° C. at a heating rate of 3° C./second or more; then keeping the sheet for at most 60 seconds at the temperature reached or not keeping; and cooling the sheet rapidly to 100° C. at a cooling rate of 2° C./second or more.

The heat treatment is performed in order to intend to dissolve Cu and Mg which are the constituents of the modulated structure made of the Al—Cu—Mg—compound to the alloy and to obtain the sufficient degree of bake hardening. In this case, when the heating treatment is performed at 500° C. or less, the above mentioned effect could not be sufficiently obtained. On the other hand, when the temperature exceeds 580° C.; when the heating rate is less than 3° C./second; or when the keeping time exceeds 60 seconds, abnormal grain growth would be readily occurred in certain grains. Further, it is not preferable that the cooling rate is less than 2° C./second in view of increasing bake hardening, since the coarse Al—Cu—Mg—compound is precipitated during the cooling step.

In addition to the steps, it is preferable to perform an intermediate annealing treatment including heating the sheet at a temperature in a range of 500° to 580° C. at a heating rate of 3° C./second or more; keeping the sheet for at most 60 seconds at the temperature reached or not keeping; and cooling the sheet to 100° C. at a cooling rate of 2° C./second, after rolling the ingot up to the intermediate thickness.

Then, the thus obtained sheet is subjected to a cold reduction of 5 to 45%.

By virtue of the additional step mentioned above, the formation of the modulated structure is accelerated, thereby increasing the degree of bake hardening.

Figure 7:
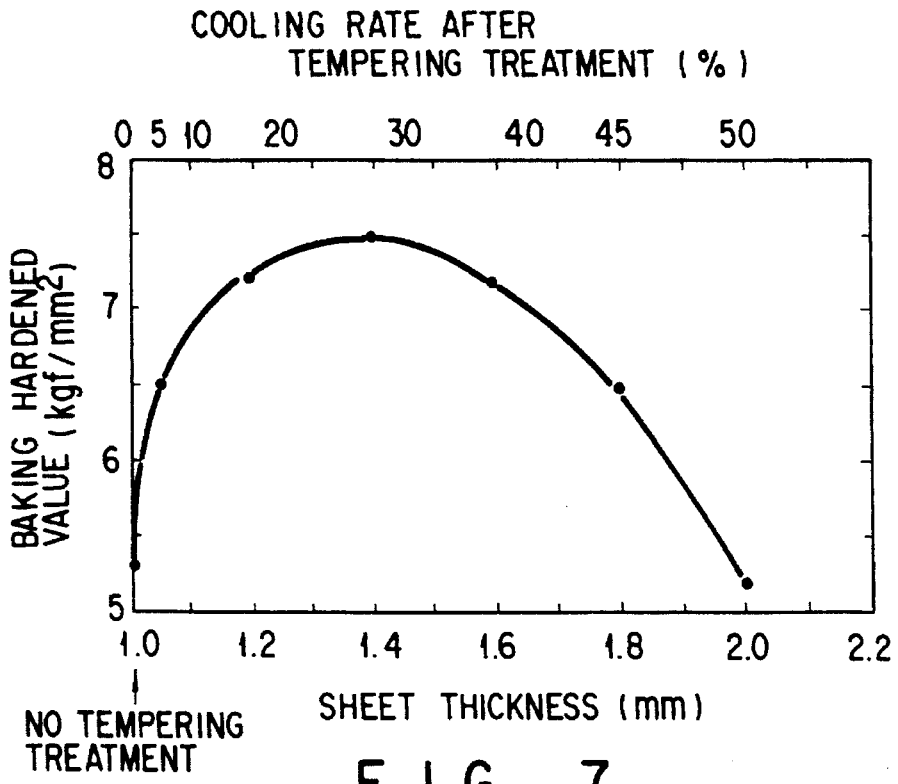
FIG. 7 is a graph showing the effect of a rolling rate of the rolling treatment following the intermediate annealing tempering treatment on the degree of bake hardening.

FIG. 7 shows the relationship between the intermediate thickness of the sheet to be subjected to an intermediate annealing treatment and the degree of bake hardening. The thicknesses of the final sheet were constant values of 1.0 mm. In addition to the intermediate sheet thickness, the rolling reductions of the cold rolling following the intermediate annealing step are also described on the abscissa axis. The degree of bake hardening is calculated by subtracting the yield strength before baking from that of after the baking. As apparent from FIG. 7, when the intermediate annealing treatment is performed in the intermediate thickness such that the rolling reduction of the final rolling step is 5 to 45%, the degree of bake hardening can be as high as 7 kg/mm$^2$. When the rolling reduction of the final rolling step is 5% or less, the formability may deteriorate since the generation of the modulated structure of the Al—Cu—Mg—compound may not be facilitated and the baking hardenability thereof may be low, and further an abnormal grain growth may occur.

The intermediate annealing condition is the same as that used in the heat treatment following the rolling step. When the heating rate and the cooling rate are below the minimum value, a coarse Al—Mg—Cu compound may be precipitated, thereby reducing baking hardenability.

The thus obtained aluminum alloy sheet is excellent in the hardening property obtained by baking at low temperature for a short period of time and suitable for use in an automobile body sheet.

EXAMPLES

Hereinafter the Examples of the present invention will be described.

Example 1

An alloy comprising the components in the contents shown in Table 1, was melted, continuously casted to form ingots. The obtained ingots were subjected to facing. The ingots were subjected to a 2-step homogenizing heat treatment, first for 4 hours at 440° C., and second, for 10 hours at 510° C. Then, the ingots were heated to 460° C. and subjected to a hot-rolling to form sheets having thickness of 4 mm. After cooled at room temperature, the above obtained sheets were subjected to a cold-rolling to obtain a sheets having thickness of 1.4 mm, followed by performing an intermediate annealing treatment which includes heating up to 550° C. at a heating rate of 10° C./second; keeping the sheets for 10 seconds at 550° C.; and air-cooling compulsorily to 100° C. at a cooling rate of 20° C./second.

After the sheets were cooled to room temperature, the sheet were subjected to a cold rolling to form the final sheets having thickness of 1 mm. Note that, the finish temperature of the hot rolling treatment was 280° C.

The above obtained sheets of 1 mm in thickness were heated to 550° C. at a heating rate of 10° C./second, kept for 10 seconds, and cooled compulsorily to 100° C. at a cooling rate of 20° C./second.

After the sheets thus obtained were allowed to age for one week at room temperature, the sheets were cut off in the predetermined shapes to conduct a tensile test (a stretched direction is and to a rolled direction, according to methods described in the Japanese Industrial Standard (JIS) No. 5, and to conduct a conical cup test which was simulated actual press forming according to JIS Z2249 (using test tool 17 type). The complex formability of overhang and. deep drawing was evaluated as the CCVF value (mm). The smaller the CCV value is, the better the formability obtained.

In order to simulate paint baking following press forming, a heat treatment was carried out at 170° C. for 20 minutes. This treatment corresponds to an actual baking step. Again, the tensile test was performed in substantially the same condition as in the above. The test pieces were observed under the microscope.

These test results are shown in Table 2. The value of the column "bake hardening" is obtained by subtracting yield strength after the final heat treatment from that after the heat treatment simulating the actual baking step. The presence or absence of the streak corresponding to the modulated structure of the Al—Cu—Mg—compound was also shown.

Alloys Nos. 1 to 15 of Table 1 contain Mg, Cu, and Si, or optional elements such as Fe, Ti, B, Mn, Cr, Zr, V, and Zn in the range of the present invention adding to above basic components. On the contrary, the alloys Nos. 16 to 30 are not within the range of composition of the present invention.

TABLE 1

| | Chemical composition (weight %) | | | | | | | | | | |
|---|---|---|---|---|---|---|---|---|---|---|---|
| Number | Mg | Si | Cu | Fe | Ti | B | Zn | Mn | Cr | Zr | V |
| 1 | 2.1 | 0.29 | 0.60 | 0.14 | 0.018 | 0.0017 | 0.13 | <0.01 | <0.01 | <0.01 | <0.01 |
| 2 | 1.6 | 0.34 | 0.50 | 0.14 | 0.015 | 0.0016 | 0.20 | <0.01 | <0.01 | <0.01 | <0.01 |
| 3 | 3.3 | 0.31 | 0.56 | 0.12 | 0.011 | 0.0011 | 0.09 | <0.01 | <0.01 | <0.01 | <0.01 |
| 4 | 2.0 | 0.09 | 0.61 | 0.17 | 0.009 | 0.0008 | 0.12 | <0.01 | <0.01 | <0.01 | <0.01 |
| 5 | 2.4 | 0.55 | 0.40 | 0.09 | 0.010 | 0.0011 | 0.07 | <0.01 | <0.01 | <0.01 | <0.01 |
| 6 | 2.1 | 0.26 | 0.35 | 0.15 | 0.013 | 0.0012 | 0.16 | <0.01 | <0.01 | <0.01 | <0.01 |
| 7 | 1.9 | 0.28 | 0.90 | 0.10 | 0.020 | 0.0019 | 0.08 | <0.01 | <0.01 | <0.01 | <0.01 |
| 8 | 2.0 | 0.30 | 0.62 | 0.42 | 0.019 | 0.0017 | 0.11 | <0.01 | <0.01 | <0.01 | <0.01 |
| 9 | 2.2 | 0.33 | 0.59 | 0.13 | 0.006 | 0.0004 | 0.10 | <0.01 | <0.01 | <0.01 | <0.01 |
| 10 | 2.1 | 0.29 | 0.50 | 0.10 | 0.120 | 0.0460 | 0.14 | <0.01 | <0.01 | <0.01 | <0.01 |
| 11 | 1.8 | 0.27 | 0.66 | 0.09 | 0.018 | 0.0018 | 0.40 | <0.01 | <0.01 | <0.01 | <0.01 |
| 12 | 2.3 | 0.30 | 0.46 | 0.12 | 0.019 | 0.0018 | 0.09 | 0.43 | <0.01 | <0.01 | <0.01 |
| 13 | 2.2 | 0.30 | 0.58 | 0.10 | 0.016 | 0.0014 | 0.12 | <0.01 | 0.13 | <0.01 | <0.01 |
| 14 | 2.0 | 0.29 | 0.59 | 0.09 | 0.014 | 0.0011 | 0.10 | <0.01 | <0.01 | 0.10 | <0.01 |
| 15 | 2.0 | 0.32 | 0.61 | 0.11 | 0.018 | 0.0017 | 0.10 | <0.01 | <0.01 | <0.01 | 0.16+ee |
| 16 | +e,uns 1.2 | 0.30 | 0.59 | 0.12 | 0.019 | 0.0017 | 0.12 | <0.01 | <0.01 | <0.01 | <0.01 |
| 17 | 3.9 | 0.29 | 0.48 | 0.10 | 0.019 | 0.0018 | 0.09 | <0.01 | <0.01 | <0.01 | <0.01 |
| 18 | 2.1 | 0.01 | 0.61 | 0.11 | 0.010 | 0.0008 | 0.10 | <0.01 | <0.01 | <0.01 | <0.01 |
| 19 | 2.0 | 0.71 | 0.60 | 0.14 | 0.014 | 0.0013 | 0.11 | <0.01 | <0.01 | <0.01 | <0.01 |
| 20 | 1.8 | 0.32 | 0.21 | 0.10 | 0.018 | 0.0017 | 0.18 | <0.01 | <0.01 | <0.01 | <0.01 |
| 21 | 2.0 | 0.28 | 1.12 | 0.13 | 0.021 | 0.0019 | 0.20 | <0.01 | <0.01 | <0.01 | <0.01 |
| 22 | 2.3 | 0.30 | 0.58 | 0.65 | 0.020 | 0.0020 | 0.13 | <0.01 | <0.01 | <0.01 | <0.01 |
| 23 | 2.2 | 0.33 | 0.62 | 0.15 | 0.002 | 0.0001 | 0.10 | <0.01 | <0.01 | <0.01 | <0.01 |
| 24 | 1.9 | 0.29 | 0.55 | 0.12 | 0.190 | 0.0620 | 0.13 | <0.01 | <0.01 | <0.01 | <0.01 |
| 25 | 1.9 | 0.32 | 0.58 | 0.12 | 0.017 | 0.0015 | 0.70 | <0.01 | <0.01 | <0.01 | <0.01 |
| 26 | 2.1 | 0.30 | 0.63 | 0.17 | 0.009 | 0.0008 | 0.17 | 0.63 | <0.01 | <0.01 | <0.01 |
| 27 | 2.0 | 0.24 | 0.55 | 0.13 | 0.015 | 0.0014 | 0.12 | <0.01 | 0.20 | <0.01 | <0.01 |
| 28 | 2.4 | 0.28 | 0.60 | 0.10 | 0.016 | 0.0014 | 0.17 | <0.01 | <0.01 | 0.20 | <0.01 |
| 29 | 2.1 | 0.31 | 0.61 | 0.12 | 0.011 | 0.0009 | 0.14 | <0.01 | <0.01 | <0.01 | 0.22 |
| 30 | 3.4 | 0.30 | 0.42 | 0.14 | 0.013 | 0.0012 | 0.09 | <0.01 | <0.01 | <0.01 | <0.01 |

TABLE 2

| Number | Properties after heat treatment | | | | Properties after baking | | |
|---|---|---|---|---|---|---|---|
| | Yield strength (kgf/mm$^2$) | Tensile strength (kgf/mm$^2$) | Elongation (%) | CCV (mm) | Presence of streak | Yield strength (kgf/mm$^2$) | Bake hardening* (kgf/mm$^2$) |
| 1 | 7.8 | 21.3 | 33.0 | 39.9 | observed | 15.3 | 7.5 |
| 2 | 6.7 | 20.1 | 31.2 | 40.1 | observed | 13.2 | 6.5 |
| 3 | 8.9 | 22.5 | 34.3 | 39.8 | observed | 15.5 | 6.6 |
| 4 | 7.3 | 20.9 | 33.5 | 39.9 | observed | 13.9 | 6.6 |
| 5 | 8.2 | 21.7 | 31.0 | 40.1 | observed | 14.9 | 6.7 |
| 6 | 7.0 | 20.3 | 33.1 | 39.9 | observed | 14.0 | 7.0 |
| 7 | 9.4 | 23.0 | 32.2 | 40.0 | observed | 16.8 | 7.4 |
| 8 | 8.1 | 21.6 | 30.9 | 40.1 | observed | 14.8 | 6.7 |
| 9 | 7.1 | 20.5 | 31.0 | 40.1 | observed | 14.6 | 7.5 |
| 10 | 8.3 | 22.0 | 30.9 | 40.1 | observed | 15.3 | 7.0 |
| 11 | 8.5 | 22.2 | 32.6 | 40.0 | observed | 15.0 | 6.5 |
| 12 | 8.0 | 21.6 | 31.2 | 40.1 | observed | 14.9 | 6.9 |
| 13 | 8.2 | 21.9 | 30.9 | 40.1 | observed | 15.1 | 6.9 |
| 14 | 8.2 | 21.8 | 30.9 | 40.1 | observed | 14.9 | 6.7 |
| 15 | 8.1 | 21.6 | 31.3 | 40.1 | observed | 15.1 | 7.0 |
| 16 | 6.2 | 19.6 | 27.7 | 40.5 | not observed | 10.0 | 3.8 |
| 17 | 9.3 | 23.0 | 34.1 | 39.8 | not observed | 12.9 | 3.6 |
| 18 | 7.3 | 20.9 | 33.2 | 39.9 | not observed | 11.2 | 3.9 |
| 19 | 9.0 | 22.8 | 30.1 | 40.2 | not observed | 12.8 | 3.8 |
| 20 | 6.7 | 20.1 | 32.9 | 40.0 | not observed | 9.9 | 3.2 |
| 21 | 10.0 | 23.7 | 30.5 | 40.2 | not observed | 13.6 | 3.6 |
| 22 | 8.5 | 22.0 | 29.2 | 40.4 | not observed | 11.6 | 3.1 |
| 23 | 6.9 | 20.3 | 28.9 | 40.4 | observed | 10.8 | 3.9 |
| 24 | 8.8 | 22.5 | 29.1 | 40.4 | observed | 11.8 | 3.0 |
| 25 | 9.1 | 22.7 | 30.7 | 40.1 | not observed | 11.5 | 2.4 |
| 26 | 8.4 | 22.0 | 28.0 | 40.5 | observed | 11.9 | 3.5 |
| 27 | 8.8 | 22.7 | 27.6 | 40.5 | observed | 12.6 | 3.8 |
| 28 | 8.7 | 22.7 | 27.9 | 40.5 | observed | 12.0 | 3.3 |
| 29 | 8.5 | 22.4 | 27.7 | 40.5 | observed | 12.2 | 3.7 |
| 30 | 7.6 | 21.1 | 33.4 | 39.9 | not observed | 11.2 | 3.6 |

*(Yield strength after baking) − (Yield strength after heat treatment)

As shown in Table 2, alloy sheets Nos. 1 to 15 show 30% or more of fracture elongation and a satisfactory CCV value, thereby demonstrating that excellent formability were obtained.

Further it was confirmed that the streak corresponding to the modulated structure of the Al—Cu—Mg—compound was generated by baking, and that the alloys possessed the value of bake hardening as high as 6.5 kgf/mm$^2$ or more in the terms of yield strength.

On the other hand, alloy sheets Nos. 16 to 30 shown in Table 2 possessed unsatisfactory values either in formability or in bake hardening. More specifically, in any of Mg, Si, and Cu contributing to bake hardening in a small amount, as well as in alloy sheets Nos. 17, 19, and 21, which contained Mg, Si, or Cu, any of which was present in a large amount, the streak could not be observed in an electron diffraction pattern which is obtained after the baking treatment and the value of bake hardening thereof was at most 4 kgf/mm$^2$. Alloy sheet, No. 25, which contained Zn in a large amount showed bake hardening as low as 2.4 kgf/mm$^2$. Alloy sheets Nos. 22, 23, 24, 26, 27, 28, and 29, which contained any of Fe, Ti-B, Mn, Cr, Zr, and V in amounts failing to fall within the range of the present invention, showed lower formability. Alloy sheet No. 30, ratio of Mg/Cu did not satisfy the range of 2 to 7, showed the value of bake hardening of 3.6 kgf/mm$^2$.

Example 2

Alloy sheets were manufactured in substantially the same condition as in Example 1 using chemical compositions Nos. 1' to 30', which corresponded to Nos. 1 to 30 shown in Table 1 except that the intermediate annealing was not performed. Substantially the same tests as in Example 1 were conducted. The results are shown in Table 3.

TABLE 3

| | Properties after heat treatment | | | | Properties after baking | | |
|---|---|---|---|---|---|---|---|
| Number | Yield strength (kgf/mm$^2$) | Tensile strength (kgf/mm$^2$) | Elongation (%) | CCV (mm) | Presence of streak | Yield strength (kgf/mm$^2$) | Bake hardening* (kgf/mm$^2$) |
| 1' | 8.3 | 21.8 | 32.8 | 40.0 | observed | 14.2 | 5.9 |
| 2' | 7.3 | 20.6 | 30.9 | 40.1 | observed | 12.5 | 5.2 |
| 3' | 9.4 | 22.9 | 34.1 | 39.8 | observed | 14.7 | 5.3 |
| 4' | 7.9 | 21.4 | 33.2 | 39.9 | observed | 13.2 | 5.3 |
| 5' | 8.7 | 22.2 | 30.9 | 40.1 | observed | 14.1 | 5.4 |
| 6' | 7.6 | 20.8 | 32.7 | 40.0 | observed | 13.2 | 5.6 |
| 7' | 9.9 | 23.5 | 31.9 | 40.0 | observed | 15.7 | 5.8 |
| 8' | 8.6 | 22.0 | 30.7 | 40.1 | observed | 13.9 | 5.3 |
| 9' | 7.6 | 20.9 | 30.7 | 40.1 | observed | 13.5 | 5.9 |
| 10' | 8.8 | 22.4 | 30.7 | 40.1 | observed | 14.3 | 5.5 |
| 11' | 9.0 | 22.6 | 32.4 | 40.0 | observed | 14.3 | 5.3 |
| 12' | 8.6 | 21.9 | 31.0 | 40.1 | observed | 14.1 | 5.5 |
| 13' | 8.7 | 22.4 | 30.6 | 40.1 | observed | 14.1 | 5.4 |
| 14' | 8.7 | 22.3 | 30.6 | 40.1 | observed | 14.1 | 5.4 |
| 15' | 8.6 | 22.1 | 31.1 | 40.1 | observed | 14.2 | 5.6 |
| 16' | 6.5 | 19.9 | 27.6 | 40.5 | not observed | 9.6 | 3.1 |
| 17' | 9.6 | 23.2 | 33.8 | 39.8 | not observed | 12.5 | 2.9 |
| 18' | 7.7 | 21.2 | 33.0 | 39.9 | not observed | 11.2 | 3.5 |
| 19' | 9.3 | 23.1 | 29.9 | 40.2 | not observed | 12.4 | 3.1 |
| 20' | 7.1 | 20.4 | 32.7 | 40.0 | not observed | 9.7 | 2.6 |
| 21' | 10.2 | 23.8 | 30.4 | 40.2 | not observed | 13.1 | 2.9 |
| 22' | 8.7 | 22.3 | 29.0 | 40.4 | not observed | 11.3 | 2.6 |
| 23' | 7.1 | 20.4 | 28.7 | 40.4 | observed | 10.3 | 3.2 |
| 24' | 9.1 | 22.7 | 28.9 | 40.4 | observed | 11.4 | 2.3 |
| 25' | 9.3 | 22.9 | 30.6 | 40.2 | not observed | 11.1 | 1.8 |
| 26' | 8.7 | 22.3 | 27.7 | 40.6 | observed | 11.5 | 2.8 |
| 27' | 9.0 | 22.9 | 27.4 | 40.6 | observed | 12.0 | 3.0 |
| 28' | 8.9 | 22.9 | 27.8 | 40.6 | observed | 11.5 | 2.6 |
| 29' | 8.8 | 22.6 | 27.4 | 40.6 | observed | 11.7 | 2.9 |
| 30' | 7.9 | 21.2 | 33.2 | 39.9 | not observed | 10.8 | 2.9 |

*(Yield strength after baking) − (Yield strength after heat treatment)

As shown in Table 3, alloy sheets Nos. 1' to 15' show 30% or more of fracture elongation as observed alloys Nos. 1 to 15 of Example 1. It was confirmed that the streak corresponding to the modulated structure of the Al—Cu—Mg—compound was generated by baking, and that the alloys showed values of bake hardening as high as 5.2 kg/mm$^2$ or more in the terms of yield strength although the bake hardening was lower than that of the alloy sheets manufactured by a process including intermediate annealing.

It was also confirmed that the degree of the bake hardening of Nos. 16' to 30' was lower than that of Nos. 16 to 30.

Example 3

Alloy sheets were manufactured using an ingot having a chemical composition corresponding to No. 1 shown in Table 1 in the condition shown in Table 4. With respect to treatments, e.g., rolling condition and the like which are not described in Table 4, substantially the same treatments as in Example 1 were employed. The manufacturing conditions, A to E in Table 4 are within the range of the present invention, but F to L are not.

With respect to the thus manufactured alloy sheets, evaluation tests were conducted in substantially the same manner as in Example 1. The results are also shown in Table 4.

TABLE 4

| Manufacturing Condition | Homogenization Condition (°C. × hr.) | Cold Reduction: Rate after intermediate annealing (%) | Heat treatment condition: Heating rate (°C./sec) | Soaking time (°C. × sec.) | Cooling rate (°C./sec) |
|---|---|---|---|---|---|
| A | 440 × 4 +510 × 10 | 28.6 | 10 | 550 × 10 | 20 |
| B | 440 × 4 +510 × 10 | " | 3 | 500 × 10 | " |
| C | 440 × 4 +510 × 10 | " | 10 | 550 × 0 | " |
| D | 500 × 16 | 16.7 | " | 550 × 10 | " |
| E | 440 × 4 +510 × 10 | 28.6 | " | " | 3 |
| F | 600 × 10 | 28.6 | 10 | 550 × 10 | 20 |
| G | 440 × 4 +510 × 10 | 3.84 | " | " | " |
| H | 440 × 4 +510 × 10 | 54.5 | " | " | " |
| I | 440 × 4 +510 × 10 | 28.6 | 1 | " | " |
| J | 440 × 4 +510 × 10 | " | 10 | 600 × 10 | " |
| K | 440 × 4 +510 × 10 | " | " | 480 × 10 | " |
| L | 440 × 4 +510 × 10 | " | " | 550 × 10 | 1 |

| Manufacturing Condition | Properties after heat treatment: Yield strength (kgf/mm$^2$) | Tensile strength (kgf/mm$^2$) | Elongation (%) | CCV (mm) | Properties after baking: Presence of streak | Yield strength (kgf/mm$^2$) | Bake hardening* (kgf/mm$^2$) |
|---|---|---|---|---|---|---|---|
| A | 7.8 | 21.3 | 33.0 | 39.9 | observed | 15.3 | 7.5 |
| B | 8.0 | 21.5 | 32.3 | 40.0 | observed | 14.8 | 6.8 |
| C | 8.1 | 21.5 | 32.5 | 40.0 | observed | 14.7 | 6.6 |
| D | 7.6 | 21.0 | 32.3 | 40.0 | observed | 14.7 | 7.1 |
| E | 8.3 | 21.7 | 32.2 | 40.0 | observed | 14.8 | 6.5 |
| F | 6.1 | 19.4 | 21.4 | 41.2 | not observed | 8.5 | 2.4 |
| G | 7.3 | 20.9 | 21.1 | 41.2 | not observed | 13.2 | 5.9 |
| H | 7.5 | 21.1 | 32.8 | 40.1 | not observed | 10.3 | 2.8 |
| I | 5.7 | 19.0 | 16.5 | 41.7 | not observed | 9.2 | 3.5 |
| J | 5.4 | 18.8 | 15.2 | 41.9 | not observed | 8.5 | 3.1 |
| K | 7.5 | 21.2 | 23.5 | 41.0 | not observed | 10.3 | 2.8 |
| L | 7.9 | 21.7 | 30.8 | 40.2 | not observed | 10.2 | 2.3 |

*(Yield strength after baking) − (Yield strength after heat treatment)

As shown in Table 4, the alloy sheets manufactured in the conditions of A to E showed satisfactory formability and bake hardening, however, the alloy sheets manufactured in the conditions of F to L showed unsatisfactory results of fracture elongation, formability, and bake hardening.

When homogenizing temperature or heat treatment temperature was high, the rolling reduction of the cold rolling following the intermediate annealing was low or the heating rate of the heating treatment was low as in Comparative Examples F, G, I, and J, abnormal grain growth occurred, with the result that the fracture elongation and the formability deteriorated.

When the rate of the cold reduction following the intermediate annealing was high, as in the case of H, or when a cooling rate at the time of a solution treatment was low, as in the case of L, the streak corresponding to the modulated structure of the Al—Cu—Mg—compound was not observed in the electron diffraction pattern, thereby causing deterioration in bake hardening. Further, when the alloy sheets were kept at low temperature in the solution treatment, as in the case of K, the formability of the alloy sheets deteriorated since fracture elongation was low and sufficient bake hardening was not obtained.

Example 4

Alloy sheets were manufactured using an ingot having a chemical composition corresponding to No. 1 of Table 1 in substantially the same condition as A to L of Example 3 except that the intermediate annealing treatment was not performed. With respect to the thus obtained alloy sheets, evaluation tests were conducted in substantially the same manner as in Example 3. The results are shown in Table 5. A' to L' in Table 5 correspond to A to L in Example 3.

TABLE 5

| Manu-facturing Condition | Homogenization Condition (°C. × hr.) | Heat treatment condiciton: Heating rate (°C./sec) | Soaking time (°C. × sec.) | Cooling rate (°C./sec) | Properties after heat treatment: Yield strength (kgf/mm²) | Tensile strength (kgf/mm²) | Elon-gation (%) | CCV (mm) | Properties after baking: Presence of streak | Yield strength (kgf/mm²) | Bake hardening* (kgf/mm²) |
|---|---|---|---|---|---|---|---|---|---|---|---|
| A' | 440 × 4 + 510 × 4 | 10 | 550 × 10 | 20 | 8.3 | 21.8 | 32.8 | 40.0 | observed | 14.2 | 5.9 |
| B' | 440 × 4 + 510 × 4 | 3 | 500 × 10 | " | 8.5 | 21.9 | 32.1 | 40.0 | observed | 13.9 | 5.4 |
| C' | 440 × 4 + 510 × 4 | 10 | 550 × 0 | " | 8.7 | 22.0 | 32.2 | 40.0 | observed | 14.0 | 5.3 |
| D' | 500 × 16 | " | 550 × 10 | " | 8.1 | 21.4 | 32.0 | 40.0 | observed | 13.6 | 5.5 |
| E' | 440 × 4 + 510 × 10 | " | " | 3 | 8.9 | 22.2 | 31.9 | 40.1 | observed | 14.1 | 5.2 |
| F' | 600 × 10 | 10 | 550 × 10 | 20 | 6.4 | 19.6 | 21.2 | 41.2 | not observed | 8.1 | 1.7 |
| I' | 440 × 4 + 510 × 10 | 1 | " | " | 6.1 | 19.2 | 16.3 | 41.7 | not observed | 8.9 | 2.8 |
| J' | 440 × 4 + 510 × 10 | 10 | 600 × 10 | " | 5.7 | 19.0 | 15.1 | 41.9 | not observed | 8.6 | 2.9 |
| K' | 440 × 4 + 510 × 10 | " | 480 × 10 | " | 7.7 | 21.3 | 23.5 | 41.0 | not observed | 10.1 | 2.4 |
| L' | 440 × 4 + 510 × 10 | " | 550 × 10 | 1 | 8.1 | 21.8 | 30.6 | 40.2 | not observed | 9.8 | 1.7 |

*(Yield strength after baking) − (Yield strength after heat treatment)

As shown in Table 5, it was confirmed that the alloy sheets manufactured in conditions A' to E' were slightly lower in bake hardening than those of A to E of Table 4, but the value itself was kept high. Further the alloys manufactured in conditions F' to L' were slightly lower in bake hardening than those of F to L shown in Table 7.

Example 5

Alloy sheets were manufactured using an chemical composition as the same as that of No. 1 in Table 1 in condition A' shown in Table 5. The properties of the alloy sheets obtained by varying the baking condition thereof were evaluated. The results are shown in Table 6 and FIG. 8.

TABLE 6

| Baking condition: Temperature (°C.) | Time (minutes) | Properties after baking: Presence of streak | Yield strength (kgf/mm²) | Bake hardening* (kgf/mm²) |
|---|---|---|---|---|
| 80 | 1 | not observed | 8.3 | 0.0 |
| | 5 | not observed | 8.5 | 0.2 |
| | 20 | not observed | 9.2 | 0.9 |
| | 40 | not observed | 9.7 | 1.4 |
| 120 | 1 | not observed | 8.3 | 0.0 |
| | 5 | obsreved | 13.4 | 5.1 |
| | 20 | observed | 13.8 | 5.5 |
| | 40 | observed | 14.2 | 5.9 |
| **Baking condition: Temperature (°C.)** | **Time (minute)** | **Properties after baking: Presence of streak** | **Yield strength** | **Bake hardening*** |
| 170 | 1 | not observed | 8.5 | 0.2 |
| | 5 | observed | 13.7 | 5.4 |
| | 20 | observed | 14.2 | 5.9 |
| | 40 | obsreved | 14.6 | 6.3 |
| 200 | 1 | not observed | 8.6 | 0.3 |
| | 5 | observed | 13.7 | 5.4 |
| | 20 | observed | 14.7 | 6.4 |
| | 40 | observed | 15.3 | 7.0 |

*(Yield strength after baking) − (Yield strength after heat treatmnet)

Figure 8:
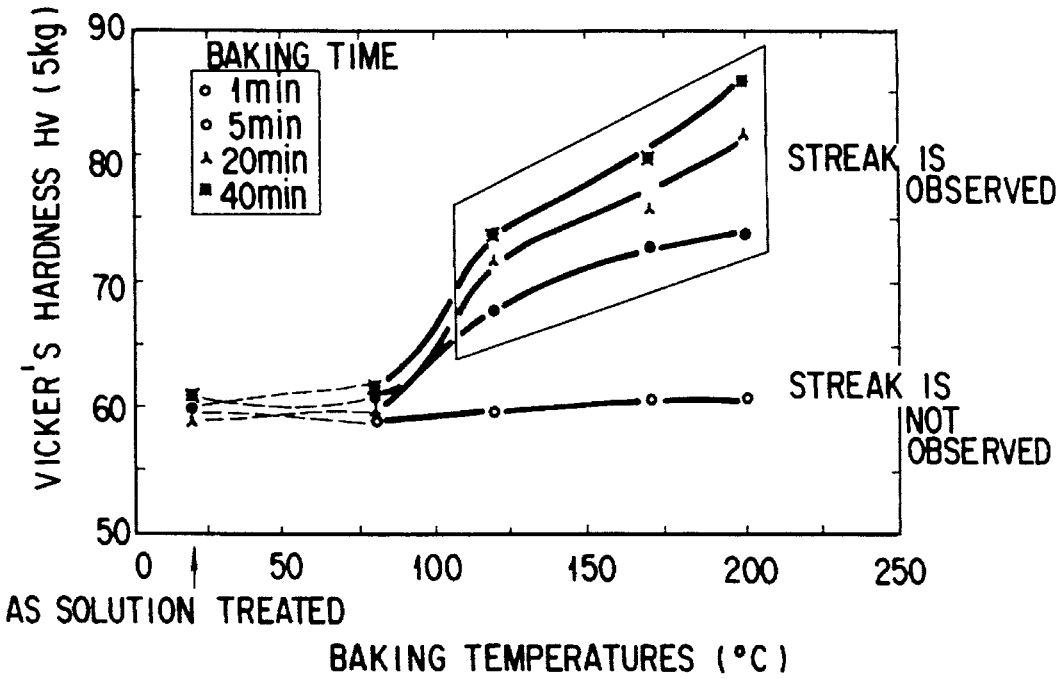
FIG. 8 is a graph showing the relationship between baking temperature and vicker's hardness after baking treatment, and between baking time and the vicker's hardness.

As shown in Table 6 and FIG. 8, the streak corresponding to the modulated structure of the Al—Cu—Mg—compound was generated by baking at a temperature in the range of 120° to 180° C. for a period of time from 5 to 40 minutes, thereby demonstrating that the alloy had high bake hardening property.

Example 6

In Example 6, the alloy sheets containing Sn, In, and Cd as additional elements were tested.

Alloy sheets of 1 mm in thickness were manufactured in substantially the same condition as in Example 1 using the alloys having chemical compositions and the contents shown in Table 7, and then subjected to the heat treatment in substantially the same condition as in Example 1.

After the heat treatment was completed, the alloys were allowed to age at room temperature for one day and 60 days in order to evaluate natural aging. Further, the tensile test and the conical cup test were conducted in substantially the same manner as in Example 1 using pieces cut off in the predetermined shape from the alloy sheet. The paint baking following press forming was simulated in substantially the same manner as in Example 1, thereby evaluating estimating the bake hardening. The test pieces were also observed under the microscope.

These results are shown in Table 8.

Nos. 31 to 46 contain Mg, Cu, and Si in the contents within the range of the present invention and further contain at least one selected from the group consisting of Sn, In, and Cd, or further contain Fe, Ti, B, Mn, Cr, Zr, V, or Zn in the contents within the present invention. The chemical compositions of Nos. 47 to 61 are not within the range of the present invention.

TABLE 7

| Alloy number | Chemical composition (weight %) | | | | | | | | | | | | | |
|---|---|---|---|---|---|---|---|---|---|---|---|---|---|---|
| | Mg | Si | Cu | Fe | Ti | B | Zn | Mn | Cr | Zr | V | Sn | In | Cd |
| 31 | 2.1 | 0.29 | 0.60 | 0.14 | 0.018 | 0.0017 | 0.13 | <0.01 | <0.01 | <0.01 | <0.01 | 0.11 | <0.01 | <0.01 |
| 32 | 1.6 | 0.34 | 0.50 | 0.14 | 0.015 | 0.0016 | 0.20 | <0.01 | <0.01 | <0.01 | <0.01 | 0.10 | <0.01 | <0.01 |
| 33 | 3.3 | 0.31 | 0.56 | 0.12 | 0.011 | 0.0011 | 0.09 | <0.01 | <0.01 | <0.01 | <0.01 | 0.08 | <0.01 | <0.01 |
| 34 | 2.0 | 0.09 | 0.61 | 0.17 | 0.009 | 0.0008 | 0.12 | <0.01 | <0.01 | <0.01 | <0.01 | 0.11 | <0.01 | <0.01 |
| 35 | 2.4 | 0.55 | 0.40 | 0.09 | 0.010 | 0.0011 | 0.07 | <0.01 | <0.01 | <0.01 | <0.01 | 0.10 | <0.01 | <0.01 |
| 36 | 2.1 | 0.26 | 0.35 | 0.15 | 0.013 | 0.0012 | 0.16 | <0.01 | <0.01 | <0.01 | <0.01 | 0.09 | <0.01 | <0.01 |
| 37 | 1.9 | 0.28 | 0.90 | 0.10 | 0.020 | 0.0019 | 0.08 | <0.01 | <0.01 | <0.01 | <0.01 | 0.13 | <0.01 | <0.01 |
| 38 | 2.0 | 0.30 | 0.62 | 0.42 | 0.019 | 0.0017 | 0.11 | <0.01 | <0.01 | <0.01 | <0.01 | 0.10 | <0.01 | <0.01 |
| 39 | 2.2 | 0.33 | 0.59 | 0.13 | 0.120 | 0.0460 | 0.14 | <0.01 | <0.01 | <0.01 | <0.01 | 0.12 | <0.01 | <0.01 |
| 40 | 1.8 | 0.27 | 0.66 | 0.09 | 0.018 | 0.0018 | 0.40 | <0.01 | <0.01 | <0.01 | <0.01 | 0.15 | <0.01 | <0.01 |
| 41 | 2.3 | 0.30 | 0.46 | 0.12 | 0.019 | 0.0018 | 0.09 | 0.43 | <0.01 | <0.01 | <0.01 | 0.08 | <0.01 | <0.01 |
| 42 | 2.2 | 0.30 | 0.58 | 0.10 | 0.016 | 0.0014 | 0.12 | <0.01 | 0.13 | <0.01 | <0.01 | 0.10 | <0.01 | <0.01 |
| 43 | 2.0 | 0.29 | 0.59 | 0.09 | 0.014 | 0.0011 | 0.10 | <0.01 | <0.01 | 0.10 | <0.01 | 0.09 | <0.01 | <0.01 |
| 44 | 2.0 | 0.32 | 0.61 | 0.11 | 0.018 | 0.0017 | 0.10 | <0.01 | <0.01 | <0.01 | 0.16 | 0.14 | <0.01 | <0.01 |
| 45 | 2.3 | 0.32 | 0.50 | 0.10 | 0.019 | 0.0018 | 0.08 | <0.01 | <0.01 | <0.01 | <0.01 | 0.42 | <0.01 | <0.01 |
| 46 | 2.0 | 0.30 | 0.62 | 0.12 | 0.016 | 0.0014 | 0.12 | <0.01 | <0.01 | <0.01 | <0.01 | <0.01 | 0.39 | 0.41 |
| 47 | 1.2 | 0.30 | 0.59 | 0.12 | 0.019 | 0.0017 | 0.12 | <0.01 | <0.01 | <0.01 | <0.01 | 0.10 | <0.01 | <0.01 |
| 48 | 3.9 | 0.29 | 0.48 | 0.10 | 0.019 | 0.0018 | 0.09 | <0.01 | <0.01 | <0.01 | <0.01 | 0.09 | <0.01 | <0.01 |
| 49 | 2.1 | 0.01 | 0.61 | 0.11 | 0.010 | 0.0008 | 0.10 | <0.01 | <0.01 | <0.01 | <0.01 | 0.12 | <0.01 | <0.01 |
| 50 | 2.0 | 0.71 | 0.60 | 0.14 | 0.014 | 0.0013 | 0.11 | <0.01 | <0.01 | <0.01 | <0.01 | 0.11 | <0.01 | <0.01 |
| 51 | 1.8 | 0.32 | 0.21 | 0.10 | 0.018 | 0.0017 | 0.18 | <0.01 | <0.01 | <0.01 | <0.01 | 0.10 | <0.01 | <0.01 |
| 52 | 2.0 | 0.28 | 1.12 | 0.13 | 0.021 | 0.0019 | 0.20 | <0.01 | <0.01 | <0.01 | <0.01 | 0.15 | <0.01 | <0.01 |
| 53 | 2.3 | 0.30 | 0.58 | 0.65 | 0.020 | 0.0020 | 0.13 | <0.01 | <0.01 | <0.01 | <0.01 | 0.08 | <0.01 | <0.01 |
| 54 | 1.9 | 0.29 | 0.55 | 0.12 | 0.019 | 0.0620 | 0.13 | <0.01 | <0.01 | <0.01 | <0.01 | 0.13 | <0.01 | <0.01 |
| 55 | 1.9 | 0.32 | 0.58 | 0.12 | 0.017 | 0.0015 | 0.70 | <0.01 | <0.01 | <0.01 | <0.01 | 0.09 | <0.01 | <0.01 |
| 56 | 2.1 | 0.30 | 0.63 | 0.17 | 0.009 | 0.0008 | 0.17 | 0.63 | <0.01 | <0.01 | <0.01 | 0.12 | <0.01 | <0.01 |
| 57 | 2.0 | 0.24 | 0.55 | 0.13 | 0.015 | 0.0014 | 0.12 | <0.01 | 0.20 | <0.01 | <0.01 | 0.10 | <0.01 | <0.01 |
| 58 | 2.4 | 0.28 | 0.60 | 0.10 | 0.016 | 0.0014 | 0.17 | <0.01 | <0.01 | 0.20 | <0.01 | 0.14 | <0.01 | <0.01 |
| 59 | 2.1 | 0.31 | 0.61 | 0.12 | 0.011 | 0.0009 | 0.14 | <0.01 | <0.01 | <0.01 | 0.22 | 0.09 | <0.01 | <0.01 |
| 60 | 2.2 | 0.38 | 0.59 | 0.11 | 0.019 | 0.0018 | 0.09 | <0.01 | <0.01 | <0.01 | <0.01 | <0.01 | <0.01 | <0.01 |
| 61 | 3.4 | 0.30 | 0.42 | 0.14 | 0.013 | 0.0012 | 0.09 | <0.01 | <0.01 | <0.01 | <0.01 | 0.11 | <0.01 | <0.01 |

TABLE 8

| Alloy number | Properties after aging experiment following heat treatment | | | | | | | |
|---|---|---|---|---|---|---|---|---|
| | After one day aging | After 60 days aging | | | | | | |
| | | Properties after heat treatment | | | | Properties after baking | | |
| | Yield strength (kgf/mm$^2$) | Yield strength (kgf/mm$^2$) | Tensile strength (kgf/mm$^2$) | Elongation (%) | CCV (mm) | Presence of streak | Yield strength (kgf/mm$^2$) | Bake hardening* (kgf/mm$^2$) |
| 31 | 7.5 | 7.7 | 21.4 | 33.2 | 39.9 | observed | 15.3 | 7.6 |
| 32 | 6.5 | 6.7 | 20.2 | 31.3 | 40.1 | observed | 13.2 | 6.5 |
| 33 | 8.8 | 8.8 | 22.4 | 34.5 | 39.8 | observed | 15.5 | 6.7 |
| 34 | 7.2 | 7.4 | 21.1 | 33.6 | 39.9 | observed | 13.9 | 6.5 |
| 35 | 8.0 | 8.0 | 21.6 | 31.3 | 40.1 | observed | 14.8 | 6.8 |
| 36 | 6.5 | 6.8 | 20.5 | 33.2 | 39.9 | observed | 13.8 | 7.0 |
| 37 | 8.9 | 9.3 | 23.1 | 32.3 | 40.0 | observed | 16.6 | 7.3 |
| 38 | 7.8 | 8.1 | 21.3 | 31.0 | 40.1 | observed | 14.8 | 6.7 |
| 39 | 7.8 | 8.0 | 22.0 | 30.8 | 40.1 | observed | 14.7 | 6.7 |
| 40 | 8.2 | 8.5 | 22.5 | 32.9 | 40.0 | observed | 14.9 | 6.4 |
| 41 | 7.6 | 8.0 | 21.5 | 31.4 | 40.1 | observed | 15.0 | 7.0 |
| 42 | 7.8 | 8.1 | 21.9 | 31.0 | 40.1 | observed | 15.1 | 7.0 |
| 43 | 8.2 | 8.2 | 21.9 | 31.0 | 40.1 | observed | 14.9 | 6.7 |
| 44 | 7.7 | 7.9 | 21.3 | 31.3 | 40.1 | observed | 15.0 | 7.1 |
| 45 | 7.8 | 8.0 | 21.5 | 32.0 | 40.0 | observed | 14.6 | 6.6 |
| 46 | 7.4 | 7.7 | 21.7 | 32.3 | 40.0 | observed | 14.7 | 7.0 |
| 47 | 5.8 | 6.1 | 19.4 | 27.9 | 40.5 | not observed | 9.9 | 3.8 |
| 48 | 8.9 | 9.1 | 22.8 | 34.3 | 39.8 | not observed | 12.8 | 3.7 |
| 49 | 7.1 | 7.3 | 21.0 | 33.3 | 39.9 | not observed | 11.1 | 3.8 |
| 50 | 8.3 | 13.3 | 26.6 | 23.1 | 41.0 | not observed | 13.4 | 0.1 |
| 51 | 6.3 | 6.5 | 20.2 | 33.1 | 39.9 | not observed | 9.8 | 3.3 |
| 52 | 9.7 | 14.8 | 26.6 | 24.1 | 40.9 | not observed | 15.5 | 0.7 |
| 53 | 8.1 | 8.7 | 22.6 | 28.9 | 40.4 | not | 10.8 | 2.1 |

TABLE 8-continued

| | Properties after aging experiment following heat treatment | | | | | | | |
|---|---|---|---|---|---|---|---|---|
| | After one day aging | After 60 days aging | | | | | | |
| | | Properties after heat treatment | | | | Properties after baking | | |
| Alloy number | Yield strength (kgf/mm$^2$) | Yield strength (kgf/mm$^2$) | Tensile strength (kgf/mm$^2$) | Elongation (%) | CCV (mm) | Presence of streak | Yield strength (kgf/mm$^2$) | Bake hardening* (kgf/mm$^2$) |
| 54 | 8.6 | 9.3 | 22.7 | 28.9 | 40.4 | observed observed | 11.2 | 1.9 |
| 55 | 8.5 | 13.6 | 27.1 | 22.3 | 41.1 | not observed | 13.7 | 0.1 |
| 56 | 7.9 | 8.6 | 22.2 | 27.5 | 40.5 | observed | 11.2 | 2.6 |
| 57 | 8.4 | 9.1 | 23.1 | 26.8 | 40.6 | observed | 11.7 | 2.6 |
| 58 | 8.2 | 8.8 | 23.0 | 27.1 | 40.6 | observed | 10.6 | 1.8 |
| 59 | 8.0 | 8.7 | 22.8 | 26.9 | 40.6 | observed | 11.3 | 2.6 |
| 60 | 8.1 | 14.4 | 26.2 | 23.5 | 41.0 | observed | 14.8 | 0.4 |
| 61 | 7.2 | 7.4 | 21.0 | 33.5 | 30.9 | not observed | 11.1 | 3.7 |

As shown in Table 8, the alloys Nos. 31 to 46 showed 30% or more of fracture elongation and satisfactory CCV values, thereby demonstrating that excellent formability was obtained. Also it was confirmed that the streak corresponding to the modulated structure of the Al—Cu—Mg—compound was generated by baking treatment, and that the value of bake hardening showed as high as 6.4 kgf/mm$^2$ in terms of yield strength. Furthermore it was confirmed that after being allowed to age for 60 days at room temperature, and that the alloys increased in the yield strength by at most 0.5 kgf/mm$^2$, thereby demonstrating that natural aging was retarded.

On the other hand, any of formability, bake hardening, and natural aging retardation of alloys Nos. 47 to 61 was unsatisfactory. For example, Nos. 47, 49, and 51 containing Mg, Si, or Cu, any of which was present in a small amount, and Nos. 48 and 50 containing Mg, Si, or Cu, any of which was present in a large amount, the streak was not observed in an electron diffraction pattern which was obtained after baking treatment and the bake hardening showed at most 4 kgf/mm$^2$. Also, alloys Nos. 50, 52, and 55 containing Si, Cu, and Zn in a large amount, respectively and No. 60 having Sn, In, and Zn in a low context, respectively, increased in yield strength (5 kgf/mm$^2$) by being allowed to age for 60 days at room temperature, thereby demonstrating that natural aging was remarkably progressed.

As the same as in Example 1, alloys Nos. 53, 54, 56, 57, 58, and 59 whose contents of Fe, Ti-B, Mn, Cr, Zr, and V were not within the range of the present invention, showed low formability. Alloy No. 61 whose Mg/Cu ratio was not within the range of the present invention, showed the value of the bake hardening of 3.7 kgf/mm$^2$.

Example 7

Alloy sheets were manufactured using an ingot having the chemical composition of No. 31 shown in Table 7 in the condition shown in Table 9. With respect to the condition and the like conditions, e.g., rolling condition and the like which are not described in Table 9, substantially the same treatment as in Example 6 were employed. The chemical compositions of alloy sheets M to Q of Table 9 are within the range, but those of alloy sheets R to X are not.

Substantially the same evaluation tests as in Example 6 were conducted with respect to the above obtained alloy sheets. The results are shown in Table 9.

TABLE 9

| | Homogenization | Cold Reduction Rate after | Heat treatment condiciton | | |
|---|---|---|---|---|---|
| Manufacturing Condition | Condition (°C. × hr.) | intermediate annealing (%) | Heating rate (°C./sec) | Soaking time (°C. × sec.) | Cooling rate (°C./sec) |
| M | 440 × 4 + 510 × 10 | 28.6 | 10 | 550 × 10 | 20 |
| N | 440 × 4 + 510 × 10 | " | 3 | 500 × 10 | " |
| O | 440 × 4 + 510 × 10 | " | 10 | 550 × 0 | " |
| P | 500 × 10 | 16.7 | " | 550 × 10 | " |
| Q | 440 × 4 + 510 × 10 | 28.6 | " | " | 3 |
| R | 600 × 10 | 28.6 | 10 | 550 × 10 | 20 |
| S | 440 × 4 + 510 × 10 | 3.84 | " | " | " |
| T | 440 × 4 + 510 × 10 | 54.5 | " | " | " |
| U | 440 × 4 + 510 × 10 | 28.6 | 1 | " | " |
| V | 440 × 4 + | " | 10 | 600 × 10 | " |

TABLE 9-continued

| | | | | | | |
|---|---|---|---|---|---|---|
| W | 510 × 10<br>440 × 4 +<br>510 × 10 | " | " | 480 × 10 | " |
| X | 440 × 4 +<br>510 × 10 | " | " | 550 × 10 | 1 |

| | Properties after 60 days aging following heat treatment | | | | Properties after baking | | |
|---|---|---|---|---|---|---|---|
| Manufacturing Condition | Yield strength (kgf/mm²) | Tensile strength (kgf/mm²) | Elon-gation (%) | CCV (mm) | Presence of streak | Yield strength (kgf/mm²) | Bake hardening* (kgf/mm²) |
| M | 7.7 | 21.4 | 33.2 | 39.9 | observed | 15.3 | 7.6 |
| N | 7.9 | 21.5 | 32.5 | 40.0 | observed | 14.8 | 6.9 |
| O | 8.0 | 21.4 | 32.6 | 40.0 | observed | 14.5 | 6.5 |
| P | 7.4 | 21.1 | 32.5 | 40.0 | observed | 14.5 | 7.1 |
| Q | 8.2 | 21.6 | 32.3 | 40.0 | observed | 14.8 | 6.6 |
| R | 6.1 | 19.3 | 21.6 | 41.2 | not observed | 8.4 | 2.3 |
| S | 7.2 | 20.8 | 21.3 | 41.2 | not observed | 12.9 | 5.7 |
| T | 7.4 | 21.0 | 32.9 | 39.7 | not observed | 10.1 | 2.7 |
| U | 5.8 | 19.0 | 16.6 | 41.7 | not observed | 9.3 | 3.5 |
| V | 5.2 | 18.6 | 15.5 | 41.9 | not observed | 8.1 | 2.9 |
| W | 7.5 | 21.3 | 23.8 | 41.0 | not observed | 10.2 | 2.7 |
| X | 7.7 | 21.7 | 31.0 | 40.2 | not observed | 10.2 | 2.5 |

As shown in Table 9 , it was confirmed that alloy sheets M to Q of the present invention showed satisfactory result of formability and bake hardening, and that sheets R to X, which did not satisfy the condition of the present invention provided unsatisfactory result of fracture elongation, formability, and bake hardening.

For example, when homogenization temperature or heat treatment temperature were high; the rate of the cold reduction following an intermediate annealing treatment was low; or the heating rate of the heat treatment was low, as in the case of alloy sheets, R, S, U, and V, abnormal grain growth appeared, thereby demonstrating that the above sheets were poor in fracture elongation and formability. when rate of the cold reduction following the intermediate annealing was high as in the case of alloy sheet T, or when the cooling rate of the solution treatment was low as in the case of alloy sheet, X, the streak corresponding to the modulated structure of the Al—Cu—Mg—compound was not observed in an electron diffraction pattern, thereby demonstrating that alloy sheets T and X were poor in bake hardening property. when the maintaining temperature of the solution treatment was low as in the case of alloy sheet W, the sheets exhibited poor formability due to poor elongation, thereby demonstrating that the sheet did not obtain sufficient bake hardening property.

Example 8

In Example 8, it was confirmed that the effect of the present invention can be provided by limiting the contents of Mg, Cu, and Si to 1.5 to 3.5%, 0.3 to 0.7%, and 0.05 to 0.35%, respectively.

Alloys Nos. 1, 4, and 6 of the above range and Nos. 5 and 7 whose chemical contents were not in the above range were processed to form the sheet of 1 mm in thickness. Heat treatment was conducted in substantially the same condition as in Example 1.

In order to study of influence of the natural aging, the sheets were allowed to age at room temperature for one day, 30 days, and 90 days after the heat treatment was completed. The tensile test and the conical cup test were conducted in substantially the same manner as in Example 1. The results are shown in Table 10.

TABLE 10

| | Properties after the aging experiment following heat treatment | | | | | |
|---|---|---|---|---|---|---|
| | One day aging | | 30 days aging | | 90 days aging | |
| Number | Yield strength (kgf/mm²) | CCV (mm) | Yield strength (kgf/mm²) | CCV (mm) | Yield strength (kgf/mm²) | CCV (mm) |
| 1 | 7.8 | 40.0 | 7.9 | 40.0 | 7.9 | 40.0 |
| 4 | 7.3 | 39.9 | 7.3 | 39.9 | 7.4 | 39.9 |
| 6 | 7.0 | 40.0 | 7.1 | 40.0 | 7.2 | 40.1 |
| 5 | 8.2 | 40.1 | 9.3 | 40.9 | 10.5 | 41.3 |
| 7 | 9.4 | 40.0 | 10.8 | 40.7 | 12.3 | 41.2 |

As shown in Table 10, alloys Nos. 1, 4, and 6 of above range hardly increased in yield strength and exhibited satisfactory CCV values even after 90 days aging at room temperature, thereby demonstrating that natural aging was retarded.

On the other hand, alloys Nos. 5 and 7, which were not in the above range, increased in yield strength in proportional to the days of the aging and exhibited poor formability.

From the results of the above Examples, it is demonstrated that there can be provided an aluminum alloy sheet and a method of manufacturing the alloy sheet for use in press forming, having excellent hardening property obtained by baking at low temperature for a short period of time, and an aluminum alloy sheet and a method of manufacturing the alloy sheet for use in press forming exhibit no secular change in strength prior to being subjected to press forming owing to low strength prior to being subjected to press forming and a natural aging retardation property.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An aluminum alloy sheet for use in press forming having an excellent property of hardening by baking at a low temperature for a short period of time, said aluminum alloy sheet comprising a Si-containing Al—Mg—Cu alloy, wherein streaks are observed in its electron diffraction pattern when it is baked at a temperature of 120° to 180° C. for 5 to 40 minutes, said streaks indicating a presence of a modulated structure of an Al—Cu—Mg—compound, the aluminum alloy consisting essentially of 1.6 to 3.5% by weight of Mg; 0.3 to 1.0% by weight of Cu; 0.05 to 0.6% by weight of Si; at least one element selected from the group consisting of 0.01 to 0.50% by weight of Sn, 0.01 to 0.50% by weight of Cd and 0.01 to 0.50% by weight of In; optionally at least one element selected from the group consisting of Fe, Ti, B, Mn, Cr, Zr, V and Zn; and a balance of Al and inevitable impurities, wherein the magnesium and copper are in a weight ratio of Mg/Cu of 2 to 7.

2. The aluminum alloy sheet according to claim 1, containing at least one element selected from the group consisting of 0.03 to 0.50% by weight of Fe, 0.005 to 0.15% by weight of Ti, 0.0002 to 0.05% by weight of B, 0.01 to 0.50% by weight of Mn, 0.01 to 0.15% by weight of Cr, 0.01 to 0.12% by weight of Zr, 0.01 to 0.18% by weight of V, and 0.5% or less by weight of Zn.

3. The aluminum alloy sheet according to claim 1, wherein the Sn is in an amount of 0.01 to 0.15% by weight.

4. An aluminum alloy sheet for use in press forming having an excellent property of hardening by baking at a low temperature for a short period of time, said aluminum alloy sheet comprising a Si-containing Al—Mg—Cu alloy which provides an excellent natural aging-retardation property, wherein streaks are observed in its electron diffraction pattern when it is baked at a temperature of 120° to 180° C. for 5 to 40 minutes, said streaks indicating a presence of a modulated structure of an Al—Cu—Mg—compound, the aluminum alloy consisting essentially of 1.6 to 3.5% by weight of Mg; 0.3 to 0.7% by weight of Cu; 0.05 to 0.35% by weight of Si; at least one element selected from the group consisting of 0.01 to 0.50% by weight of Sn, 0.01 to 0.50% by weight of Cd and 0.01 to 0.50% by weight of In; optionally at least one element selected from the group consisting of Fe, Ti, B, Mn, Cr, Zr, V and Zn; and a balance of Al and inevitable impurities, wherein the magnesium and copper are in a weight ratio of Mg/Cu of 2 to 7.

5. The aluminum alloy sheet according to claim 4, containing at least one element selected from the group consisting of 0.03 to 0.50% by weight of Fe, 0.005 to 0.15% by weight of Ti, 0.0002 to 0.05% by weight of B, 0.01 to 0.50% by weight of Mn, 0.01 to 0.15% by weight of Cr, 0.01 to 0.12% by weight of Zr, 0.01 to 0.18% by weight of V, and 0.5% or less by weight of Zn.

6. The aluminum alloy sheet according to claim 4, wherein the Sn is in an amount of 0.01 to 0.15% by weight.

* * * * *